US005413348A

United States Patent [19]

Basso

[11] Patent Number: 5,413,348

[45] Date of Patent: May 9, 1995

[54] GOLF TEE ANCHORING SYSTEM

[76] Inventor: Alfonso Basso, R. D. 1, Box 177B, South America Rd., Worcester, N.Y. 12197

[21] Appl. No.: 254,904

[22] Filed: Jun. 6, 1994

[51] Int. Cl.[6] ..... A63B 69/36; A63B 57/00

[52] U.S. Cl. ..... 273/208; 223/202; 223/207

[58] Field of Search ..... 273/33, 202–212

[56] References Cited

U.S. PATENT DOCUMENTS

| | | | |
|---|---|---|---|
| 1,552,991 | 9/1925 | Jones . | |
| 1,631,270 | 6/1927 | Jones | 273/212 |
| 1,638,448 | 8/1927 | Manson | 273/202 |
| 1,655,751 | 1/1928 | Cody . | |
| 1,670,123 | 5/1928 | Ranseen | 273/209 |
| 4,114,878 | 9/1978 | Hammond . | |
| 4,336,940 | 6/1982 | Sprague . | |
| 4,524,974 | 6/1985 | Matsuura | 273/207 |
| 5,242,170 | 9/1993 | Ward . | |

FOREIGN PATENT DOCUMENTS

| | | | |
|---|---|---|---|
| 109972 | 3/1940 | Australia | 273/207 |
| 401453 | 11/1933 | United Kingdom | 273/33 |

*Primary Examiner*—Vincent Millin
*Assistant Examiner*—Steven B. Wong
*Attorney, Agent, or Firm*—John A. Merecki

[57] ABSTRACT

A golf tee anchoring system including a substantially indestructible, reusable tee member, an anchoring element which is adapted to be inserted into the ground to prevent the loss of the tee member, and a flexible tether for coupling the tee member to the anchoring element. The reusable tee member incorporates a tubular, resilient upper ball support portion to prevent any tee breakage or dislodgement due to the impact of a golf club head thereagainst.

11 Claims, 4 Drawing Sheets

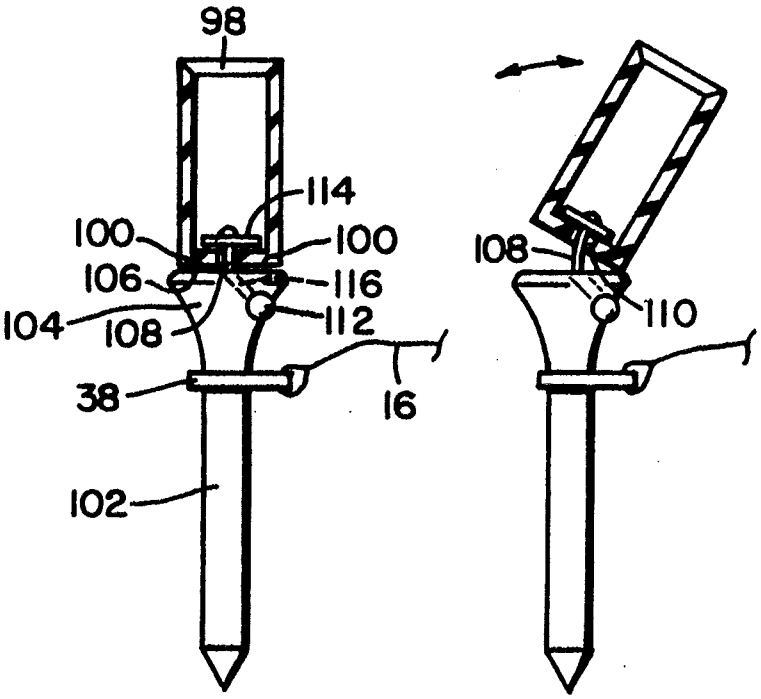
FIG. 17
FIG. 18
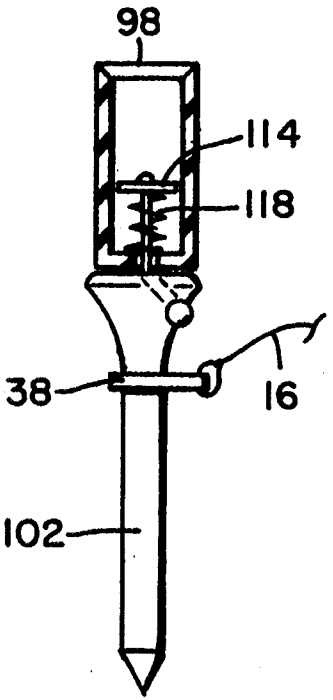
FIG. 19
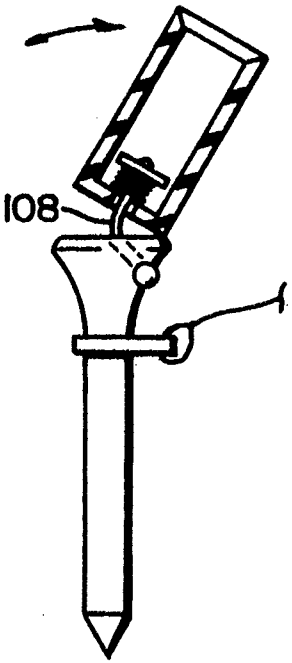
FIG. 20

GOLF TEE ANCHORING SYSTEM

FIELD OF THE INVENTION

The present invention relates to the sport of golf and, more particularly, to a golf tee anchoring system generally comprising a substantially indestructible, reusable tee member, an anchoring element which is adapted to be secured into the ground to prevent the unwanted loss of the tee member, and a flexible tether for securing the tee member to the anchoring element. Advantageously, the tee member incorporates a tubular, resilient upper ball support portion to prevent any tee breakage or dislodgement due to the impact of a golf club head thereagainst.

BACKGROUND OF THE INVENTION

As is well known in the sport of golf, tees formed from wood typically break and/or become lost when struck by the head of a golf club, thereby requiring a golfer to bring a large quantity of wooden tees to the golf course or driving range. In an attempt to overcome the breakage problem commonly associated with wooden tees, a wide variety of plastic tees have been produced. Unfortunately, although plastic tees are nearly indestructible, they are typically ejected from the ground and catapulted a large distance through the air when struck by the head of a golf club, due to the inherent material characteristics of most plastics. As such, the robustness of plastic tees is negatively balanced by an increased probability of tee loss.

In order to prevent the above-described, annoying loss of wooden and plastic golf tees, several golf tee anchoring systems have been developed, each comprising a ball support tee and an anchoring element for tethering the ball support tee to the ground. Unfortunately, currently available golf tee anchoring systems suffer from a wide variety of disadvantages as detailed hereinbelow.

U.S. Pat. No. 1,655,751 to Cody discloses a golf tee anchoring system comprising first and second conventional wooden tees which are coupled together by a string. A pair of detachable, metal, annular washers, each including an inwardly projecting tip which is adapted to penetrate into the wooden shank of a tee, and a notch for receiving an end portion of the coupling string, are utilized to connect together the first and second tees. However, by forming the tees from wood, and by weakening the wooden shank of the ball supporting tee by inserting the inwardly projecting tip of a washer therein, the tee anchoring system disclosed by Cody is highly susceptible to tee breakage.

U.S. Pat. No. 1,552,991 to Jones discloses a golf tee anchoring system which prevents tee loss while simultaneously avoiding the inherent breakage problem of wooden tees. Specifically, Jones' golf tee anchoring system utilizes a metal anchoring pin to secure a tee, having a body formed either entirely from plastic, or having a body comprising a plastic head mounted on a metal shank, into the ground. Unfortunately, when utilizing a tee having a plastic shank, the tee will typically "pop" out of the ground if it is struck by the head of a golf club, due to the resiliency of most plastic materials. Consequently, when on a driving range, a golfer must repeatedly reinsert the tee into the ground to tee off a new golf ball. Further, if a metal shank is utilized, the force of the golf club may bend the tee, rendering it substantially unusable.

U.S. Pat. No. 4,336,940 to Sprague illustrates a golf tee holder which is tethered to a conventional green repair tool. The golf tee holder comprises a generally cylindrical, resilient, hollow body having an upper body opening through which a golf tee is inserted. When fully inserted into the golf tee holder, the concave head of the tee is disposed slightly below the upper rim of the cylindrical, hollow body of the holder, with the lower shank of the tee protruding outward from the bottom of the hollow body. As such, the upper section of a golf tee is fully enclosed within a protective shell, thereby reducing the probability of tee breakage. Unfortunately, the decreased degree of tee breakage afforded by the Sprague's golf tee holder is offset by a greatly increased chance of the tee being lifted out of the ground when struck by a club. Consequently, the golf tee holder would not be suitable for use on a driving range where a plurality of golf balls are typically driven in rapid succession Ward, in U.S. Pat. No. 5,242,170, discloses a two piece golf tee having an upper sleeve portion for receiving a golf ball thereon, and a lower spike portion which is designed to remain in the ground when struck by a golf club. The two piece golf tee is assembled by snapping the upper sleeve portion over and around a flange which is integrally formed on the top of the lower spike portion. To prevent the detachment of the upper sleeve and the lower spike portions of the two piece golf tee, a flexible retainer shaft extends from the top of the lower spike portion and is slidably received within the upper sleeve portion of the tee. When the tee is struck by a golf club, the upper sleeve portion separates from the lower spike portion and slides upward along the flexible retainer shaft. In theory, the upper sleeve portion is designed to snap back over the flanged top of the lower spike portion, thereby assuming its proper orientation, after being struck by a golf club. However, in actual use, the upper sleeve portion commonly does not snap back to its original seated configuration, thereby requiring a user to reseat the upper sleeve portion on the lower spike portion prior to driving another golf ball.

SUMMARY OF THE INVENTION

In order to avoid the disadvantages of the prior art, the present invention provides a golf tee anchoring system having a substantially indestructible, reusable tee member and an anchoring element which is adapted to prevent the unintentional loss of the tee member due to the impact of a golf club thereagainst. Several embodiments of a golf tee anchoring system constructed in accordance with the present invention, each incorporating the above-described general configuration, are described in detail hereinbelow.

BRIEF DESCRIPTION OF THE DRAWINGS

These and other features of the present invention will become readily apparent upon reading the following detailed description and upon reference to the drawings in which:

FIGS. 13–14, 15–16, 17–18 and 19–20 illustrate other reusable tee members (in partial cross-section) which may be utilized in conjunction with the golf tee anchoring system of the present invention.

DETAILED DESCRIPTION OF THE INVENTION

Figure 1:
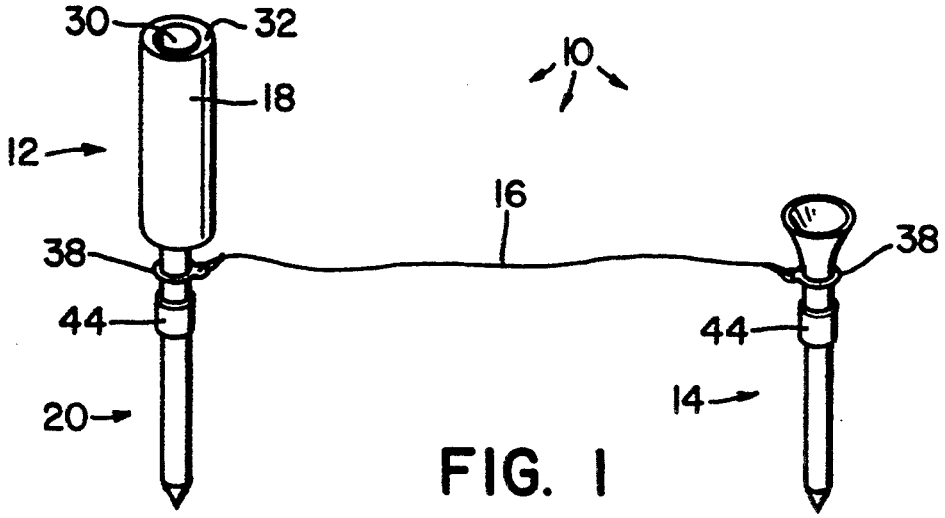
FIG. 1 is a perspective view of a golf tee anchoring system having a tee member and an anchoring element, in accordance with a first embodiment of the present invention.

Referring now specifically to the drawings, there is illustrated a golf tee anchoring system, generally designated as 10, in accordance with several embodiments of the present invention, wherein like reference numerals refer to like components throughout the drawings.

A first embodiment of a golf tee anchoring system 10 is illustrated in FIG. 1. Specifically, the golf tee anchoring system includes a substantially indestructible, reusable tee member 12, an anchoring element 14 which is adapted to be inserted into the ground to prevent the loss of the tee member 12, and a flexible tether 16, preferably comprised of a clear monofilament fishing line and having a length of approximately 4 to 12 inches, for coupling the tee member 12 to the anchoring element 14.

In accordance with the first embodiment of the present invention, the tee member 12 incorporates a substantially cylindrical, tubular, resilient upper ball support portion 18, preferably formed of a rubber material and having a height of approximately $1\frac{1}{2}$–$1\frac{3}{4}$" and a conventional golf tee 20 or other suitable ground penetrating element. As known in the art, and as further detailed in FIG. 2, a conventional golf tee 20 generally includes an enlarged, upper concave head portion 22 which is configured to receive a golf ball 24 thereon, and a shaft portion 26 which is adapted to be inserted into the ground 28. The conventional golf tee 20 may be formed from wood, plastic or other suitable material. The upper ball support 18 includes an upper opening 30 having an inwardly and downwardly beveled edge portion 32, an interior cavity 34, and a smaller diameter lower opening 36 for receiving the shaft portion 26 of the golf tee 20 therethrough. Preferably, the diameter of the interior cavity 34 is slightly smaller that the corresponding diameter of the golf tee head portion 22, thereby producing a pressure fit between the inner surface of the cavity 34 and the periphery of the golf tee head portion 22. Similarly, the diameter of the lower opening 36 is slightly smaller than the diameter of the golf tee shaft portion 26, again producing a pressure fit therebetween. As should be readily apparent from FIGS. 1 and 2, the tee member 12 is constructed by inserting the shaft portion 26 of the tee 20 through the cavity 34 and lower opening 36 of the ball support portion 18 until the head portion 22 of the tee is fully seated against the bottom of the ball support portion 18.

The anchoring element 14 is again preferably formed from a conventional golf tee constructed of wood, plastic or other appropriate material. As described above in regard to tee 20, the anchoring element includes a head portion 22 and a shaft portion 26 which is adapted to be inserted into the ground 28 a short distance from tee 20. Of course, a wide variety of anchoring elements may be utilized in lieu of a conventional golf tee.

Figure 3:
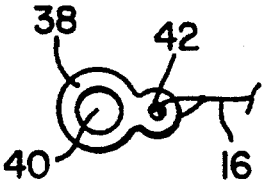
FIG. 3 is a plan view of an O-ring which may be utilized to tether a tee member to an anchoring element.
Figure 2:
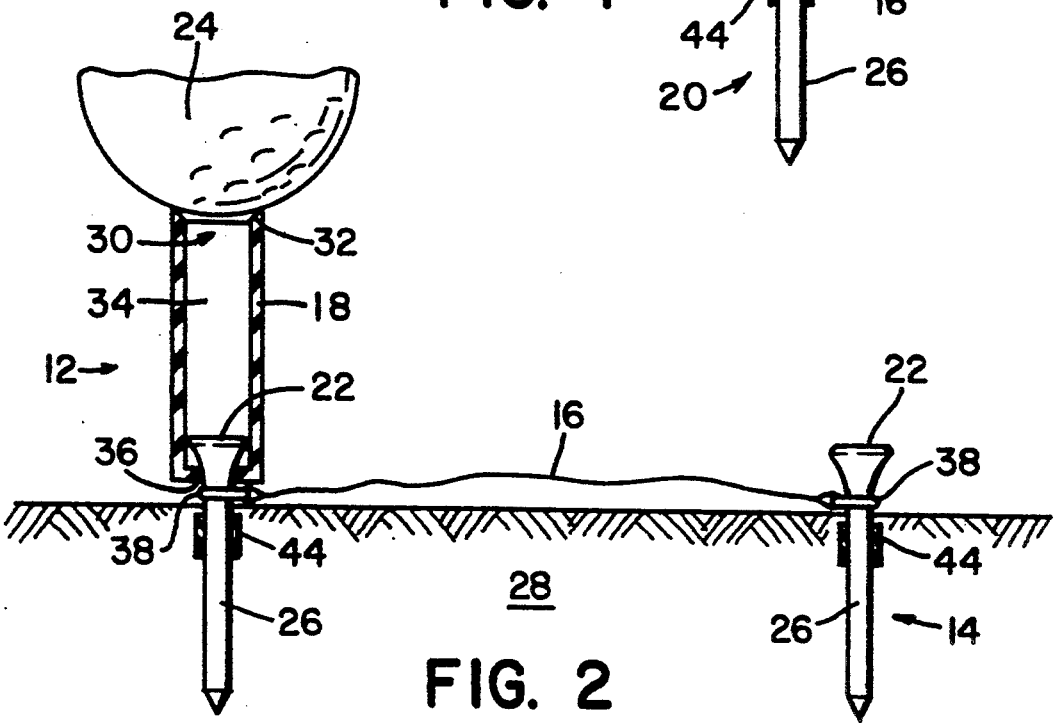
FIG. 2 is a cross-sectional view of the golf tee anchoring system illustrated in FIG. 1, with the tee member and anchoring element inserted into the ground.

As detailed above, and as illustrated in FIGS. 1 and 2, a flexible tether 16 is utilized to connected the tee member 12 to the anchoring element 14. Specifically, the flexible tether is suitably secured to an elastic O-ring 38 which is adapted to encircle the shaft portions 26 of the tee 20 and the anchoring element 14. Referring to FIG. 3, the O-ring 38 includes a first aperture 40 for receiving the shaft portion of the tee 20 or anchoring element 14 therethrough, and a second aperture 42 through which an end section of the flexible tether 16 is secured. Preferably, the diameter of the first aperture 40 is configured to be slightly smaller than the diameter of the golf tee shaft portion 26, thereby preventing the elastic O-ring 38 from inadvertently slipping off the shaft. To further prevent the elastic O-ring 38 from slipping of the golf tee shaft portion 26, an auxiliary, elastic, elongated retainer 44 is mounted therebelow. Again, the inner diameter of the retainer 44 is designed to be slightly smaller than the diameter of the golf tee shaft portion 26.

In operation, as illustrated in FIG. 2, the reusable tee member 12 and the anchoring element 14 are inserted into the ground 28 a short distance apart, with the flexible tether extending between the tee member 12 and the anchoring element 14. Preferably, the tee member 12 and the anchoring element 14 are forced downwardly until the golf tee shaft portions 26 are fully inserted into the ground 28. When properly inserted, the head portion 22 of tee 20 extends slightly above ground level. As such, the resilient upper ball support portion 18 is the only portion of the tee member 12 which is struck by a golf club when driving a golf ball mounted thereon. When the upper ball support portion 18 is struck by the head of a golf club, it will be temporarily deformed due to its resilient nature, and will immediately return to its preimpact orientation, thereby allowing the user to quickly tee up another golf ball.

Figure 4:
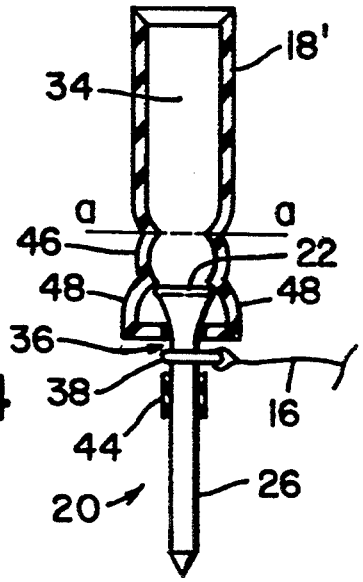
FIGS. 4 and 5 are cross-sectional views of alternate upper ball support portions.

A further embodiment of the tubular, resilient, upper ball support portion 18' is illustrated in FIG. 4. A corrugated section 46 is provided to facilitate the deformation of the ball support portion 18' when it is struck by the head of a golf club. Specifically, the ball support portion 18' is designed to bend about line a—a in response to club impact. The bottom sides 48 of the corrugated section 46 are inwardly turned, preferably extending over and onto the head 22 of the golf tee 20, thereby securing the head thereunder. As in the first embodiment of the ball support portion 18, a lower opening 36 is provided for snugly receiving the shaft portion 26 of the golf tee 20.

Figure 5:
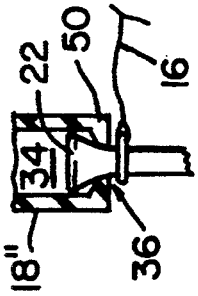

An additional embodiment of the tubular, resilient, upper ball support portion 18'' is illustrated in FIG. 5. In this embodiment, the annular bottom 50 of the ball support portion 18'' has been upwardly beveled to substantially correspond to the shape of the golf tee head 22.

Figure 9:
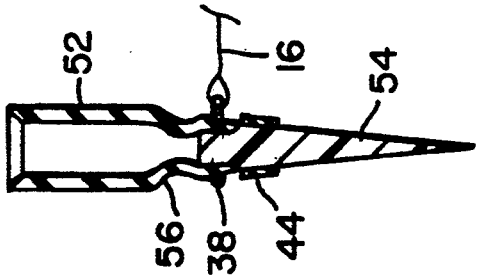
FIG. 6 through 9 illustrate alternate embodiments one the tee member in cross-section.
Figure 8:
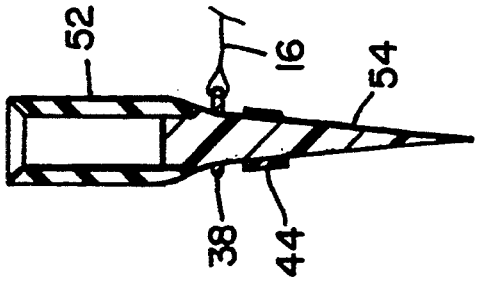
Figure 7:
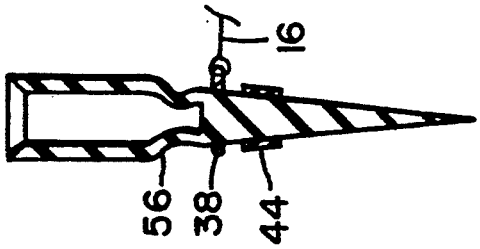
Figure 6:
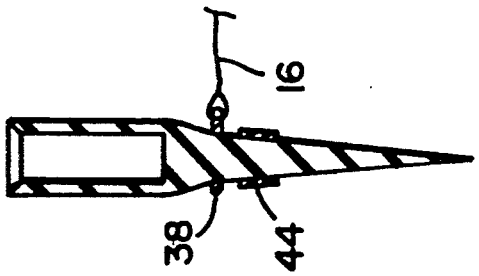
Figure 10:
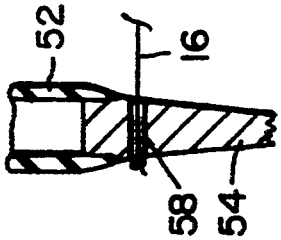
FIG. 10 illustrates an additional method for securing the flexible tether to the shaft portion of a tee.

The tee member 12 of the present invention may be additionally formed entirely of a rubber-type material as shown in FIGS. 6 and 7, or, as illustrated in FIGS. 8–9, may have a resilient upper ball support portion 52 permanently secured over the top of a rigid plastic or wooden ground penetrating element 54. Further, the upper ball support portion of the tee members may have a substantially cylindrical, tubular configuration (FIGS. 6 and 8), or may be substantially cylindrical and tubular, with a corrugated bottom portion 56 (FIGS. 7 and 9). Again, an elastic O-ring 38 (and associated retainer 44) may be utilized to secure each of the tee members illustrated in FIGS. 6–9 to a corresponding anchoring element (not shown). Alternately, referring now to FIG. 10, an end section of the flexible tether 16 may be inserted through a bore 58 formed in an upper portion of the ground penetrating element 54. After proper insertion through the ground penetrating element 54 and corresponding anchoring element (not shown), the end sections of the flexible tether 16 may be knotted or otherwise enlarged to secure the tether therebetween.

Figure 11:
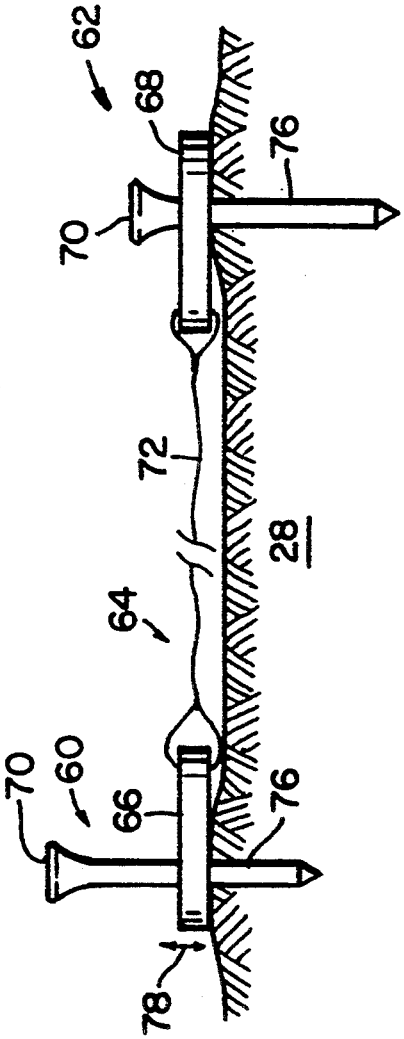
FIG. 11 is a front elevational view of a golf tee anchoring system in accordance with yet another embodiment of the present invention.

Referring now specifically to FIG. 11, there is illustrated a golf tee anchoring system in accordance with yet another embodiment of the present invention. Specifically, the golf tee anchoring system includes first and second conventional golf tees 60 and 62, formed of wood, plastic or other suitable material, which are adapted to serve as a golf ball support and anchoring element, respectively. A tethering system 64 is utilized to couple the golf tees 60, 62. The tethering system 64 includes first and second, substantially annular tee connectors 66 and 68, each formed of a semi-resilient rubber-type material and having an outside diameter which is substantially larger than the maximum diameter of the tee head portions 70, and a flexible tether 72.

Figure 12:
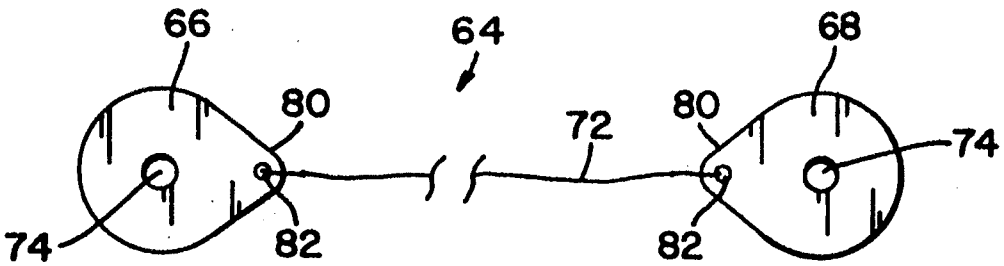
FIG. 12 is a plan view of the tee tethering system shown in FIG. 11.

As illustrated further in FIG. 12, each tee connector 66, 68 includes a first aperture 74 having a diameter which is slightly smaller than the outer diameter of the shaft portion 76 of each conventional golf tee 60, 62. Accordingly, each tee connector is tightly but longitudinally movable along its respective shaft portion 76 as indicated by directional arrows 78. Each tee connector 66, 68 further includes a protuberance 80 having a second aperture 82 which is adapted to receive an opposing end section of the flexible tether 72 therethrough.

The tee connector 66, which is longitudinally movable along the shaft 76 of the golf tee 60, serves several useful functions. For example, the tee connector 66 may be displaced upwardly or downwardly along the shaft 76 of the golf tee 60 to adjust the relative distance from a golf ball positioned thereon (not shown) to the ground 28. As such, the tethering system 64 synergistically provides a tee height adjusting mechanism and a golf tee anchoring system. Further, due to their relatively large diameters, the tee connectors 66, 68 are adapted to receive a user's fingers thereon when inserting the golf tees 60, 62, respectively, into the ground, thereby facilitating the tee insertion process.

Referring now to FIGS. 13–20, there are illustrated a plethora of additional, substantially indestructible, reusable tee members which may be utilized in the golf tee anchoring system of the present invention. Generally, each of the tee members incorporates a spring-back mechanism for repositioning a substantially cylindrical, tubular, resilient ball support portion on top of a ground penetrating element, after the ball support portion has been struck by the head of a golf club. Additionally, each of the tee members may be secured to an anchoring element (not shown) as heretofore described via an elastic O-ring 38, flexible tether 16 and optional elongated retainer (not shown).

Figure 14:
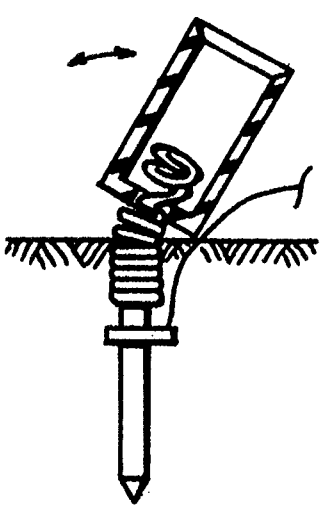
Figure 13:
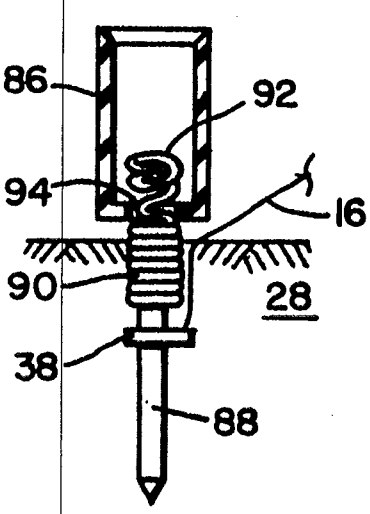

The tee member 84 illustrated in FIGS. 13 and 14 includes a resilient upper ball support portion 86, a ground penetrating element 88, and a spring 90 for coupling the upper ball support portion 86 and the ground penetrating element 88. The spring 90 encircles the upper section of the ground penetrating element 88, and includes an expanded, convoluted end portion 92 which is designed to extend through an aperture 94 in the bottom of the upper ball support portion 86 and into the interior thereof, thereby securing the spring 90 within the upper ball support portion 86. In operation, as shown in FIG. 14, the upper ball support portion 86 is adapted to oscillate about the top of the ground penetrating element 88 in response to the impact of a golf club thereagainst, eventually returning to its preimpact orientation due to the biasing of the spring 90.

Figure 16:
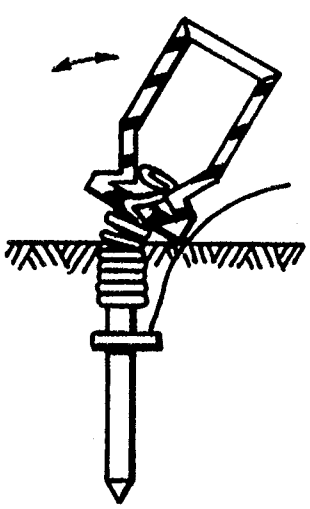
Figure 15:
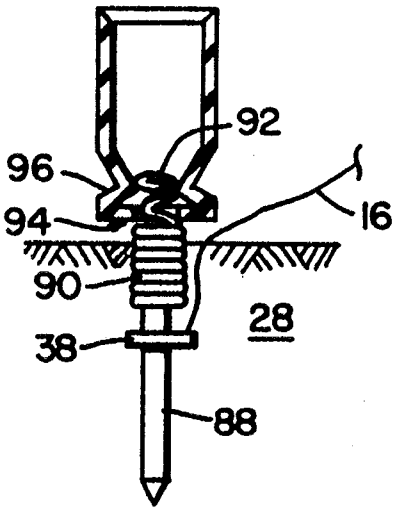

As illustrated in FIGS. 15 and 16, the resilient upper ball support portion of the tee member may include a flanged bottom rim 96 for receiving the fingers of a user, thereby facilitating the insertion of the ground penetrating element 88 into the ground 28. Again, as shown in FIG. 16, the biasing of the spring 90 is designed to return the upper ball support portion to its preimpact orientation after the tee member has been struck by the head of a golf club.

FIGS. 17 and 18 illustrate yet another embodiment of a reusable tee member. Specifically, the tee member includes a resilient upper ball support portion 98 having a substantially flat bottom surface 100, a ground penetrating element 102 having an enlarged head 104 with a substantially flat upper surface 106, and a resilient shaft 108, preferably formed from an elastic, rubber-type material, for interconnecting the upper ball support portion 98 and the ground penetrating element 102 through an aperture 110 in the bottom of the ball support portion 98. The resilient shaft 108 further includes a first enlarged end section 112, which is adapted to lockably protrude through an aperture disposed on the side of the enlarged head 104 of the ground penetrating element 102, and a second, enlarged, circular end section 114 for engaging the inner bottom surface of the upper ball support portion 98. As illustrated, the resilient shaft 108 extends from the aperture in the side of the enlarged head, through a bore 116, finally exiting through an aperture which is centrally positioned on the flat upper surface 106 of the enlarged head 104. In operation, the resilient shaft 108 is designed to prevent the resilient upper ball support portion 98 from detaching from the ground penetrating element 102 upon club head contact. Advantageously, again in response to the impact of a club, the resilience of the shaft 108 is adapted to rapidly and centrally reseat the flat bottom surface 100 of the ball support portion 98 upon the flat upper surface 106 of the enlarged head 104, thereby allowing a user to quickly tee up another golf ball.

The tee member shown in FIGS. 17 and 18 may further include a spring 118 (FIGS. 19 and 20) for enhancing and accelerating the reseating of the flat bottom surface 100 of the ball support portion 98 upon the flat upper surface 106 of the enlarged head 104 after a club impact. Preferably, the spring 118 encircles a portion of the resilient shaft 108 directly below the second, enlarged, circular end section 114 thereof, thereby sandwiching the spring 118 between the end section 114 and the inner bottom surface of the upper ball support portion 98. Accordingly, as shown in FIG. 20, the spring 118 is compressed in response to the club head actuated displacement of the upper ball support portion 98, additionally biasing the upper ball support portion toward its original, preimpact location on the ground penetrating element 102.

The foregoing description of the preferred embodiments of the invention has been presented for purposes of illustration and description. It is not intended to be exhaustive or to limit the invention to the precise form disclosed, and obviously many modifications and variations are possible in light of the above teaching. For example, each of the above-described tee members may be utilized without an anchoring element attached thereto. Further, the upper ball support portion of each tee member may be configured in a wide variety of lengths, thereby allowing a user to interchangeably vary the height of the tee member in accordance with club selection. Such modifications and variations that may be apparent to a person skilled in the art are intended to be included within the scope of this invention as defined by the accompanying claims.

I claim:

1. A golf tee anchoring system comprising:

a tee member including a substantially tubular, resilient upper portion for supporting a golf ball thereon, and a ground penetrating element for inserting said tee member into the ground, the upper ball support portion of said tee member further including an upper aperture for receiving and supporting said golf ball, and a lower aperture for snugly receiving a lower shaft portion of said ground penetrating element completely therethrough, with an enlarged upper head portion of said ground penetrating element positioned within the upper portion of said tee member adjacent said lower aperture;

an anchoring element having a ground penetrating element; and a tethering system for coupling said tee member and said anchoring element, said tethering system including a first elastic O-ring which is secured about the ground penetrating element of said tee member, a second elastic O-ring which is secured about the ground penetrating element of said anchoring element, first and second elastic, elongated retainers, each secured about said ground penetrating elements below the first and second elastic O-rings, respectively, and a flexible tether for securing said first elastic O-ring to said second elastic O-ring.

2. The golf tee anchoring system according to claim 1, wherein said first and second elastic O-rings each include first and second openings, said first opening having a diameter which is slightly smaller than the diameters of the ground penetrating elements of said tee member and anchoring element, thereby creating a pressure fit therebetween, said second opening having a diameter which is sufficiently large to receive an end section of said flexible tether therethrough.

3. The golf tee anchoring system according to claim 1, wherein the substantially tubular, resilient upper portion of said tee member includes a corrugated bottom section for snugly enclosing the enlarged upper head portion of the ground penetrating element of said tee member.

4. The golf tee anchoring system according to claim 1, wherein the substantially tubular, resilient upper portion of said tee member includes a bottom section having interior walls which extend upwardly from said lower aperture, substantially conforming to the enlarged upper head portion of the ground penetrating element of said tee member.

5. The golf tee anchoring system according to claim 1, wherein the substantially tubular, resilient upper portion and the ground penetrating element of said tee member are integrally formed.

6. The golf tee anchoring system according to claim 1, wherein the ground penetrating element of said tee member is removably secured within the substantially tubular, resilient upper portion of said tee member, thereby allowing a user to replace the ground penetrating element upon breakage.

7. A golf tee anchoring system comprising;

a golf tee including a lower ground penetrating element for insertion into the ground, and an enlarged upper head portion, having an outer diameter, for receiving and supporting a golf ball thereabove, said golf tee supporting said golf ball a predetermined distance above the ground;

an anchoring element having a ground penetrating element for insertion into the ground; and a tethering system for coupling said golf tee and said anchoring element, said tethering system including a first O-ring which is snugly and removably secured about the lower ground penetrating element of said golf tee and slidably displaceable along the length thereof, a second O-ring which is secured about the ground penetrating element of said anchoring element, and a flexible tether for securing said first O-ring to said second O-ring, said first O-ring having an outer diameter which is significantly larger than the outer diameter of the enlarged upper head portion of said golf tee;

said first O-ring further including a bottom surface which is adapted to be positioned against the ground upon insertion of the lower ground penetrating element of said golf tee into the ground, and an upper surface for receiving and supporting a user's fingers thereon during the insertion of the lower ground penetrating element of said golf tee into the ground;

wherein, said first O-ring may be slidably displaced along the length of the lower ground penetrating element of said golf tee to adjustably limit the penetration of the lower ground penetrating element of said golf tee into the ground, thereby controlling the predetermined distance between a golf ball supported on the enlarged upper head portion of said golf tee and the ground.

8. The golf tee anchoring system according to claim 7, wherein said anchoring element is a golf tee.

9. The golf tee anchoring system according to claim 8, wherein said first and second O-rings are identical.

10. The golf tee anchoring system according to claim 9, wherein said first and second O-rings each include first and second openings, said first opening having a diameter which is slightly smaller than the ground penetrating element of said golf tees, thereby creating a pressure fit therebetween, said second opening having a diameter which is sufficiently large to receive an end section of said flexible tether therethrough.

11. A golf tee anchoring system comprising:

a tee member including a substantially tubular, resilient upper portion for supporting a golf ball thereabove, a ground penetrating element for inserting said tee member into the ground, and a resilient shaft, having an enlarged upper section, for removably coupling the substantially tubular, resilient upper portion of said tee member against the ground penetrating element of said tee member, the substantially tubular, resilient upper portion of said tee member further including a flat bottom having an aperture therethrough, said resilient shaft slidably extending through said aperture, with the enlarged upper section of said resilient shaft internally disposed within the substantially tubular, resilient upper portion of said tee member;

an anchoring element having a ground penetrating element;

a tethering system for coupling said tee member and said anchoring element; and a spring internally interposed between the enlarged upper section of the said resilient shaft and the flat bottom of the substantially tubular resilient portion of said tee member;

wherein the ground penetrating portion of said tee member includes an enlarged head, said enlarged head having a flat upper surface which is adapted to removably engage the flat bottom of the substantially tubular, resilient portion of said tee member.

* * * * *